US006053763A

United States Patent [19]

Brennan et al.

[11] Patent Number: 6,053,763

[45] Date of Patent: Apr. 25, 2000

[54] ELECTRICAL CONNECTOR WITH MULTI-FUNCTION TERMINALS

[75] Inventors: Denise Brennan, Laois; Tony Mahon, Gallway; Donagh O'Sullivan; Matthew Wilhite, both of Limerick, all of Ireland

[73] Assignee: Molex Incorporated, Lisle, Ill.

[21] Appl. No.: 09/129,583

[22] Filed: Aug. 5, 1998

[51] Int. Cl.[7] ..... H01R 3/00

[52] U.S. Cl. ..... 439/491; 439/570

[58] Field of Search ..... 439/491, 570, 439/500, 862, 289; 29/740

[56] References Cited

U.S. PATENT DOCUMENTS

| | | | |
|---|---|---|---|
| 4,009,921 | 3/1977 | Narozny | 339/99 R |
| 4,509,811 | 4/1985 | Amano et al. | 339/17 F |
| 4,731,923 | 3/1988 | Yagi et al. | 29/833 |
| 5,007,097 | 4/1991 | Mizuoka et al. | 382/8 |
| 5,057,027 | 10/1991 | Yamada et al. | 439/83 |
| 5,104,689 | 4/1992 | Hayden et al. | 427/123 |
| 5,186,654 | 2/1993 | Enomoto et al. | 439/570 |
| 5,281,169 | 1/1994 | Kiat et al. | 439/607 |
| 5,507,657 | 4/1996 | Seto et al. | 439/135 |
| 5,528,825 | 6/1996 | Miyauchi et al. | 29/740 |
| 5,538,435 | 7/1996 | Yohn | 439/188 |
| 5,622,519 | 4/1997 | Bixler et al. | 439/570 |

*Primary Examiner*—Michael L. Gellner
*Assistant Examiner*—Antoine Ngandjui
*Attorney, Agent, or Firm*—Stephen Z. Weiss

[57] ABSTRACT

A charging connector is provided for mounting on a printed circuit board and includes a dielectric housing. A triple-function terminal is mounted on the housing and includes a charger portion exposed on the exterior of the housing, a fixing portion for securing the connector to the circuit board, and a reflector portion having a reflective surface visible from exteriorly of the housing for detection by a fabricating device. Another terminal is a dual-function terminal and includes a charger portion as well as an enlarged fixing portion. A pair of additional metal reflector members also are mounted on the housing to provide triangular coordinates with the reflector portion of the triple-function terminal.

11 Claims, 4 Drawing Sheets

ELECTRICAL CONNECTOR WITH MULTI-FUNCTION TERMINALS

FIELD OF THE INVENTION

This invention generally relates to the art of electrical connectors and, particularly, to a connector which includes terminals that perform a plurality of functions other than conducting current.

BACKGROUND OF THE INVENTION

Generally, a typical electrical connector includes a housing fabricated of dielectric material such as plastic or the like. The housing mounts one or more conductive terminals usually of metal material, such as of stamped and formed sheet metal material. The primary function of the terminals is to conduct current or electricity from one connecting device to another.

One type of electrical connector is a charging connector used in such applications as portable or mobile telephone apparatus. The charging connector may be part of an overall input-output (I/O) connector assembly. Charging connectors also are used in various other applications, such as video recorders or the like. In a charging connector, charger terminals have charging pads which are exposed on the exterior of the connector housing. The I/O or charging connector often is mounted on a printed circuit board.

With circuit board mounted connectors of the character described above, fixing members often are used to secure the connector to the board. The fixing members often are called "fitting nails" and are fabricated of metal material, with enlarged planar portions for connection, as by soldering, to mounting pads on the printed circuit board.

Still further, due to the ever-increasing miniaturization of electrical connectors, robotic fabricating devices are used not only in assembly operations but in "pick-and-place" operations for positioning the connector on a printed circuit board. Visible reference points may be provided on the connector for detection by a fabricating device, such as a camera, during the pick-and-place operation, using triangular calculations to rotate the connector into its correct position. In other words, the reference points comprise triangular coordinates which are detected by the camera, and these reference points or triangular coordinates often are reflective surfaces. It is difficult or expensive to provide a good reflective surface on the plastic material of a connector housing.

Aside from the ever-increasing miniaturization of electrical connectors, in general, in such environments as mobile telephone apparatus, one of the dominant design considerations is the overall size of the apparatus, particularly the handset and its associated battery pack as well as in its charging connector. Therefore, if the connector requires separate components such as charger terminals, separate fixing members or fitting nails, and separate reflecting surfaces on the connector housing, it often is difficult if at all possible to design electrical connectors to meet all of the desired size restrictions. The present invention is directed to solving these problems by providing an electrical connector, such as a charging connector, which includes one or more terminals that perform multi-functions in a single component. In fact, one of the terminals herein performs all of the functions described above, including providing a charger pad, a fitting nail as well as a reflective surface.

SUMMARY OF THE INVENTION

An object, therefore, of the invention is to provide a new and improved electrical connector, such as a charging connector, which includes multi-function terminals.

In the exemplary embodiment of the invention, the connector is adapted for mounting on a printed circuit board and includes a dielectric housing. At least one triple-function terminal is mounted on the housing and includes a charger portion exposed on the exterior of the housing. A fixing portion of the terminal secures the connector to an appropriate mounting pad on the printed circuit board. A reflector portion of the terminal provides a reflective surface visible from exteriorly of the housing for detection by a fabricating device.

As disclosed herein, the triple-function terminal is generally U-shaped to define a pair of leg portions joined by a cross portion. The cross portion forms a charger pad for the terminal. One of the leg portions has the reflective surface thereon. The other of the leg portion has the fixing portion thereon.

The connector also includes at least one dual-function terminal mounted on the housing and includes the charger portion exposed on the exterior of the housing. The terminal also includes an enlarged fixing portion for securing the connector to an appropriate mounting pad on the printed circuit board. The charger portion of the terminal is exposed at a first side of the housing, and the fixing portion of the terminal is exposed at a second side of the housing adjacent to and at generally a right angle to the first side.

According to another aspect of the invention, a plurality of metal reflector components are mounted on the housing. Each reflector component includes a reflective surface visible from exteriorly of the housing for detection by a fabricating device, such as a camera. In order to provide triangular coordinates, the reflective surface on the triple-function terminal can be used in conjunction with two other metal reflector components in a triangulated pattern.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
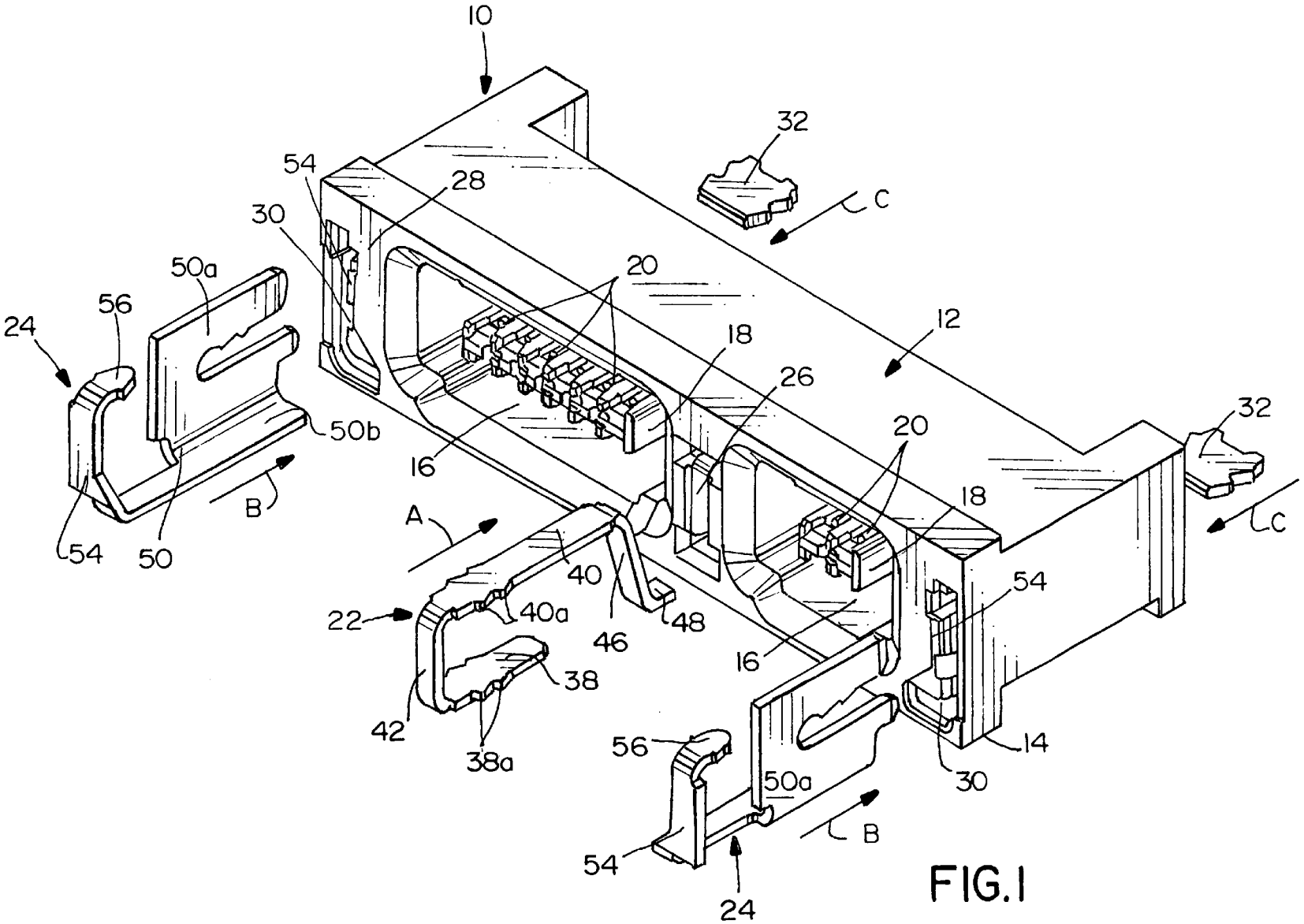
FIG. 1 is an exploded top perspective view of an electrical connector embodying the concepts of the invention.

Referring to the drawings in greater detail, and first to FIG. 1, the features of the invention are incorporated in an input/output (I/O) electrical connector, generally designated 10, which includes a one-piece housing, generally designated 12, fabricated of dielectric material such as plastic or the like. The housing and, therefore, the connector has a bottom mounting face 14 whereby the connector is adapted for mounting on an appropriate printed circuit board (not shown). I/O connector 10 includes a pair of receptacles 16 having interior mounting flanges 18 which mount a plurality of signal terminals having contact portions 20 exposed on mounting flanges 18 for engaging the contact portions of terminals on a complementary mating connector or connectors (not shown) which are plugged into receptacles 16.

Still referring to FIG. 1, I/O connector 10 also functions as a charging connector and includes three charging terminals, including a center charging terminal, generally designated 22, and a pair of side charging terminals, generally designated 24. Center charging terminal 22 is inserted into an I-shaped opening 26 in a mating face 28 of housing 12 in the direction of arrow "A". Side charging terminals 24 are inserted into a pair of L-shaped openings 30 in the mating face of the housing in the direction of arrows "B".

Figure 2:
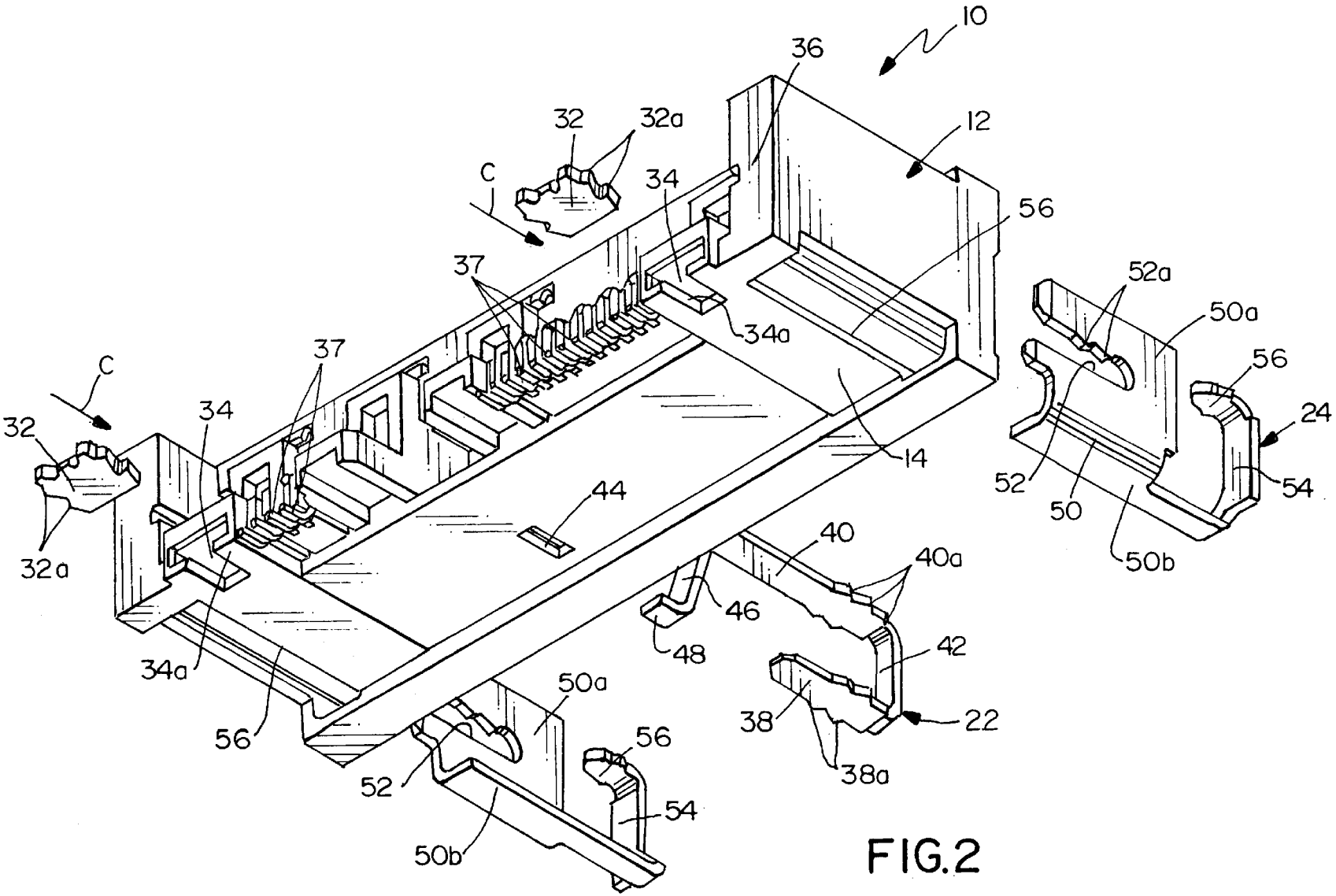
FIG. 2 is an exploded bottom perspective view of the connector.

Referring to FIG. 2 in conjunction with FIG. 1, a pair of reflector members 32 are insertable into a pair of openings 34 in a rear face 36 of housing 12 in the direction of arrows "C". The reflector members are stamped of metal material, and at least the bottom side of the members (i.e. the side visible in FIG. 2) are provided with highly reflective surfaces. When the reflector members are fully inserted into openings 34, the reflective surfaces are visible from exteriorly of the housing through windows 34*a* communicating with openings 34. The reflector members have teeth 32*a* stamped in their side edges for biting into the plastic material of the housing at the sides of openings 34 to retain the reflector members seated within the housing, with the reflective surfaces exposed through windows 34*a*. FIG. 2 also shows that the signal terminals include tail portions 37 for connection, as by soldering, to appropriate circuit traces on the printed circuit board.

Figure 3:
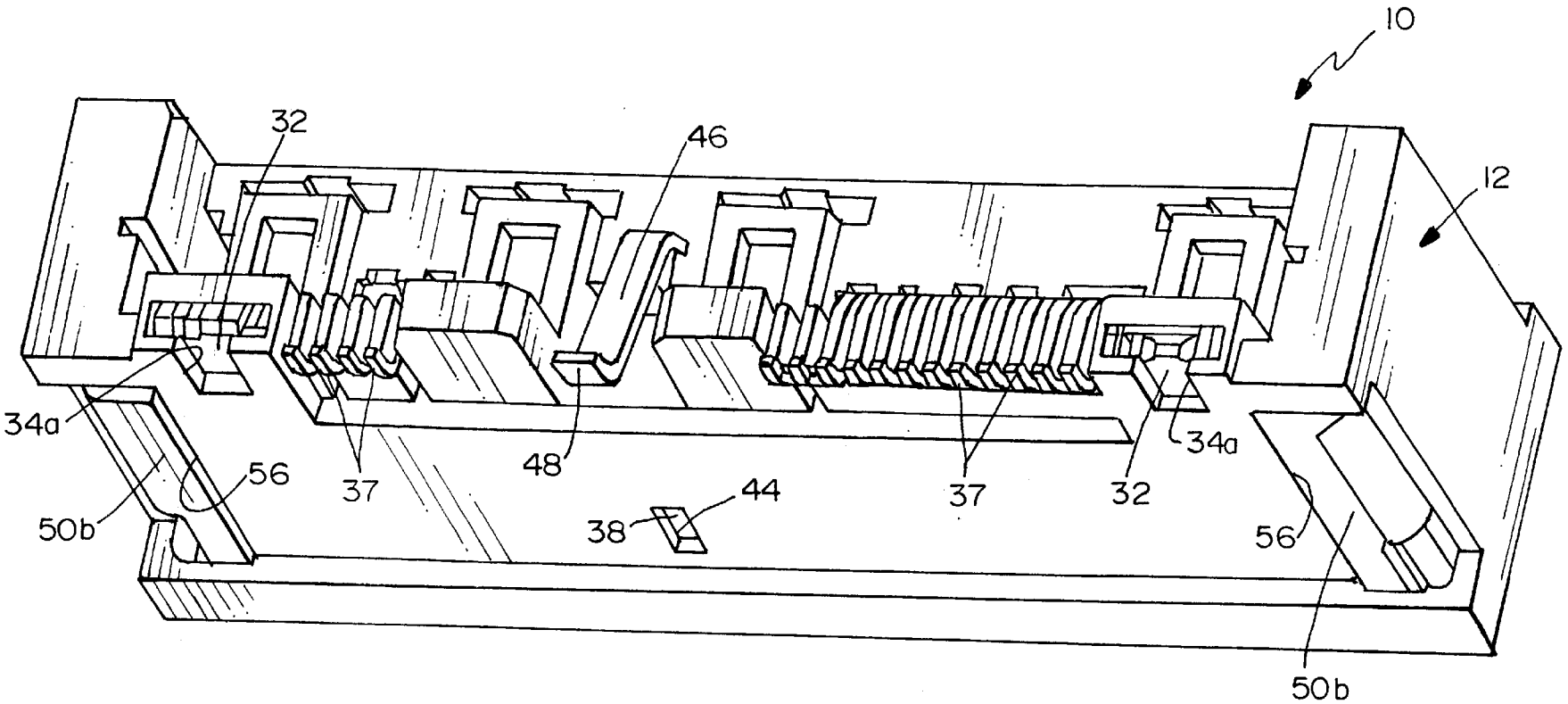
FIG. 3 is a bottom perspective view of the connector in assembled condition.

Referring to both FIGS. 1 and 2, center charging terminal 22 is generally U-shaped to define a pair of leg portions 38 and 40 joined by a bight or cross portion 42. The terminal is stamped and formed from conductive sheet metal material. Leg portions 38 and 40 are stamped with teeth 38*a* and 40*a*, respectively, for biting into the plastic material of the housing within I-shaped opening 26 to retain the terminal mounted in the housing. At least the bottom surface of leg portion 38 is provided with a highly reflective surface which is visible from exteriorly of the housing through a window 44 (FIG. 2) in the bottom of the housing. Cross portion 42 of the connector forms the charger portion or pad of the terminal. An arm 46 projects from the distal end of leg portion 40 back toward leg portion 38 and terminates in a generally planar foot 48 which defines a fixing portion or "fitting nail" of the terminal. When center charging terminal 22 is fully inserted into the housing as shown in FIG. 3, arm 46 projects rearwardly of the housing, and planar fixing portion 48 is exposed for connection, as by soldering, to an appropriate mounting pad on the printed circuit board, which mounting pad is electrically connected to a circuit trace on the printed circuit board.

Each side charging terminal 24 also is stamped and formed of sheet metal material and includes an L-shaped body 50 insertable into its respective L-shaped opening 30 (FIG. 1) in mating face 28 of housing 12. Body 50 has a vertical plate portion 50*a* provided with a slot 52 having interior teeth 52*a*. When the terminal is inserted into its respective opening 30, slot 52 straddles a flange 54 (FIG. 1) interiorly of the opening, and teeth 52*a* bite into the plastic material of the flange to retain the terminal in the housing. Body 50 has a horizontal flange 50*b* which projects rearwardly to a cross portion 54 of the terminal. Flange 50*b* defines a fixing portion or "fitting nail" which is exposed through a window 56 (FIG. 2) in the housing for securing the connector, as by soldering, to an appropriate mounting pad on the printed circuit board. Cross portion 54 defines a charger pad for the terminal. The cross portion terminates in an angled, toothed tip 56 which bites into the plastic material of the housing within opening 30 to further retain the terminal in the housing and to provide stability for charger pad 54.

Figure 4:
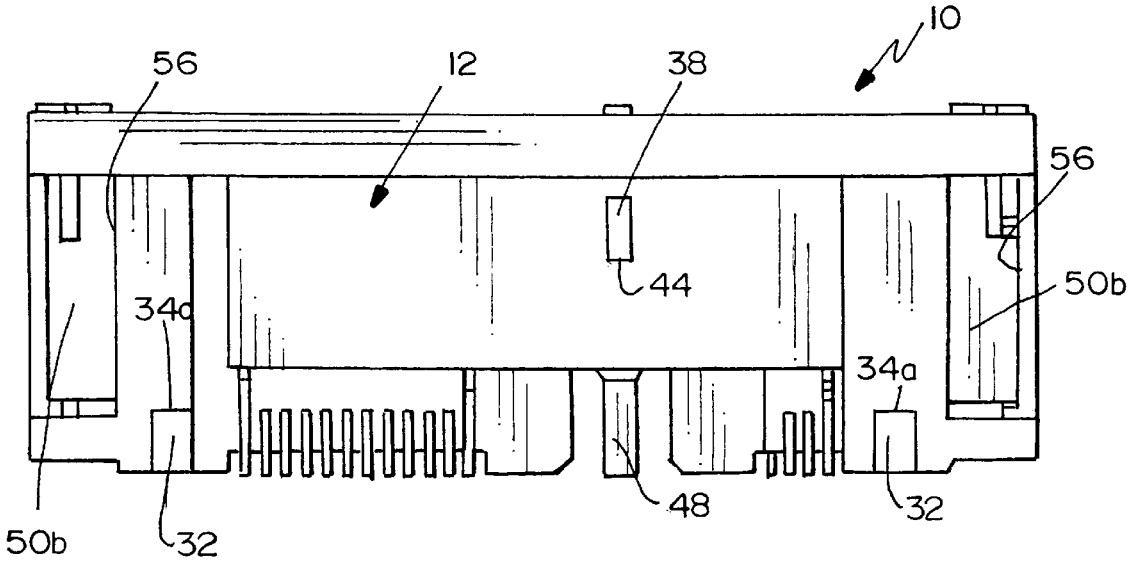
FIG. 4 is a bottom plan view of the assembled connector.

Reference now is made to FIG. 4. When all three of the charging terminals 22 and 24 are fully inserted into connector housing 12, flanges 50*b* of the side charging terminals and foot 48 of the center charging terminal are exposed at the bottom of the housing as can be seen in FIG. 4. Flanges 50*b* and foot 48 of the three terminals are coplanar and provide enlarged areas which can be connected, as by soldering, to appropriate mounting pads on the printed circuit board. Therefore, all three terminals function as "fitting nails" and separate fitting nails of the prior art are totally eliminated.

Still referring to FIG. 4, the reflective surfaces of reflector portions 32 are visible through windows 34*a*, and the reflective surface on leg portion 38 of the center charging terminal is visible through window 44 of the housing. It can be seen that the three reflective surfaces provided by the two reflector members and the center charging terminal are in a triangulated pattern. Therefore, the three reflective surfaces define triangular coordinates which can be used in triangular calculations by a camera during a pick-and-place operation to manipulate/rotate the connector during fabrication and/or assembly.

Figure 5:
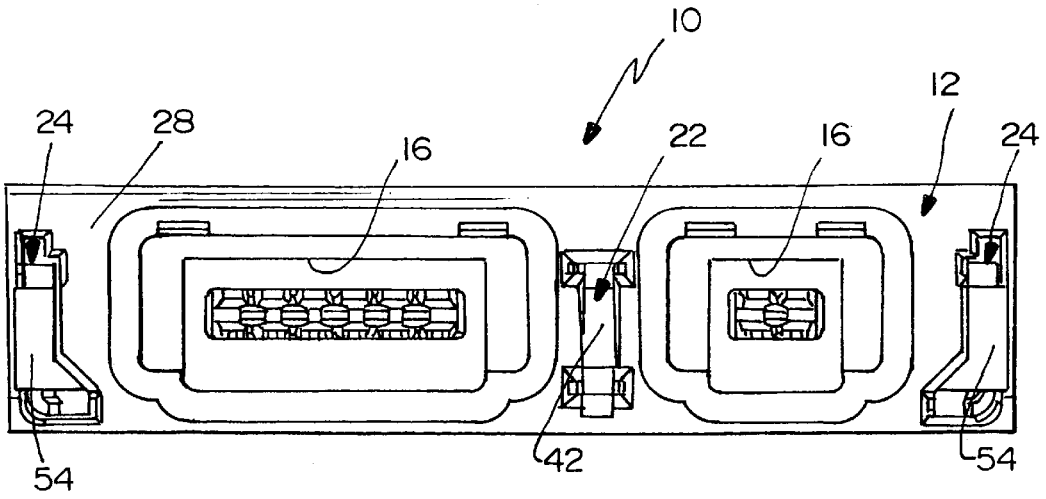
FIG. 5 is an elevational view of the mating face of the connector.

Finally, referring to FIG. 5, with center charging terminal 22 and side charging terminals 24 fully inserted into their respective openings in mating face 28 of connector housing 12, cross portion 42 of the center charging terminal and cross portions 54 of the side charging terminals define three linearly spaced charger pads for the connector. It can be seen that the center charging terminal and its charger pad is located between receptacles 16 of the I/O connector, and the charger pads of the side charging terminals are located outside the receptacles near the side edges of the connector housing. From the foregoing, it can be understood that center charging terminal 22 is a triple-function terminal, namely: (1) cross portion 42 functions as a charger pad for the connector, (2) leg portion 38 functions as a reflector member of the connector and (3) foot 48 functions as a "fitting nail" for the connector. Each side charging terminal 24 performs a dual function of (1) providing a charger pad 54 for the connector and (2) a fitting nail for the connector. By providing additional reflector members 32 in conjunction with the reflective surface on the center charging terminal, triangular coordinates are provided for the connector without having to provide expensive reflecting surfaces on the connector housing.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A charging connector for mounting on a printed circuit board, comprising:

a dielectric housing; and at least one triple-function terminal mounted on the housing and including a charger portion exposed on the exterior of the housing, a fixing portion for securing the connector to an appropriate mounting pad on the printed circuit board, and a reflector portion having a reflective surface visible from exteriorly of the housing for detection by a fabricating device.

2. The charging connector of claim 1, including at least one separate metal reflector member mounted on the housing and having a second reflective surface visible on the same side of the housing as the reflective surface on the terminal.

3. The charging connector of claim 1 wherein said terminal is generally U-shaped defining a pair of leg portions joined by a cross portion, the cross portion forming said charger portion of the terminal.

4. The charging connector of claim 3 wherein one of said leg portions has said reflective surface thereon.

5. The charging connector of claim 3 wherein the other of said leg portions has said fixing portion thereon.

6. The charging connector of claim 5 wherein the other of said leg portions has an arm on a distal end thereof projecting toward said one of said leg portions, with said fixing portion being on a distal end of the arm.

7. A charging connector, comprising:

a dielectric housing; and at least one dual-function terminal mounted on the housing and including a charger portion exposed on the exterior of the housing, and a reflector portion having a reflective surface visible from exteriorly of the housing for detection by a fabricating device.

8. The charging connector of claim 7 wherein said charger portion of the terminal is exposed at a first side of the housing and said reflector portion of the terminal is exposed at a second side of the housing.

9. The charging connector of claim 8 wherein said first and second sides of the housing are adjacent sides at generally right angles to each other.

10. An electrical connector for mounting on a printed circuit board, comprising:

a dielectric housing; and at least one dual-function terminal mounted on the housing and including a fixing portion for securing the connector to an appropriate mounting pad on the printed circuit board, and a reflector portion having a reflective surface visible from exteriorly of the housing for detection by a fabricating device.

11. The electrical connector of claim 10 wherein said fixing portion and said reflector portion are exposed at a same side of the housing.

* * * * *